US007839367B2

(12) United States Patent
Fish et al.

(10) Patent No.: US 7,839,367 B2
(45) Date of Patent: Nov. 23, 2010

(54) ACTIVE MATRIX DISPLAY DEVICES

(75) Inventors: David A. Fish, Haywards Heath (GB); Steven C. Deane, Deane (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1066 days.

(21) Appl. No.: 10/598,749

(22) PCT Filed: Feb. 28, 2005

(86) PCT No.: PCT/IB2005/050728

§ 371 (c)(1),
(2), (4) Date: Sep. 11, 2006

(87) PCT Pub. No.: WO2005/091268

PCT Pub. Date: Sep. 29, 2005

(65) Prior Publication Data

US 2007/0182674 A1 Aug. 9, 2007

(30) Foreign Application Priority Data

Mar. 16, 2004 (GB) ..... 0405807.9

(51) Int. Cl.
*G09G 3/32* (2006.01)

(52) U.S. Cl. ..... 345/82; 345/55; 345/81

(58) Field of Classification Search ..... 345/55, 345/76, 81, 82, 87
See application file for complete search history.

(56) References Cited

U.S. PATENT DOCUMENTS 6,392,617 B1 * 5/2002 Gleason ..... 345/82
6,441,560 B1 * 8/2002 Hunter ..... 315/169.1
2001/0055008 A1 12/2001 Young et al.
2002/0084463 A1 7/2002 Sanford et al.
2003/0052614 A1 3/2003 Howard
2003/0214245 A1 11/2003 Yamazaki et al.
2004/0196221 A1 * 10/2004 Shih ..... 345/82
2006/0038758 A1 * 2/2006 Routley et al. ..... 345/81

FOREIGN PATENT DOCUMENTS

EP 1096466 A1 5/2001
WO 200120591 A1 3/2001
WO 0213510 A1 2/2002
WO 2005004097 A1 1/2005

OTHER PUBLICATIONS

ISR: PCT/IB05/050728.
Written Opinion: PCT/IB05/050728.

* cited by examiner

*Primary Examiner*—Amare Mengistu
*Assistant Examiner*—Koosha Sharifi

(57) ABSTRACT

An active matrix EL display device has pixels comprising an EL display element, a drive transistor and a storage capacitor for storing a voltage to be used for controlling the addressing of the drive transistor. Each pixel also has a light-dependent device for controlling discharge of the storage capacitor, thereby to alter the control of the drive transistor in dependence on the light output of the display element. A circuit is associated with the drive transistor for increasing the rate of discharge of the storage capacitor when the storage capacitor is discharged in response to the light dependent device output. This improvement in the rate of capacitor discharge ensures that good correction for differential aging is obtained at all grey levels.

10 Claims, 9 Drawing Sheets

ACTIVE MATRIX DISPLAY DEVICES

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known active matrix electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support.

FIG. 2 shows in simplified schematic form the most basic pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as a p-type TFT, so that the storage capacitor 24 holds the gate-source voltage fixed. This results in a fixed source-drain current through the transistor, which therefore provides the desired current source operation of the pixel.

In the above basic pixel circuit, for circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

In addition to variations in transistor characteristics there is also differential ageing in the LED itself. This is due to a reduction in the efficiency of the light emitting material after current stressing. In most cases, the more current and charge passed through an LED, the lower the efficiency.

There have also been proposals for voltage-addressed pixel circuits which compensate for the aging of the LED material. For example, various pixel circuits have been proposed in which the pixels include a light sensing element. This element is responsive to the light output of the display element and acts to leak stored charge on the storage capacitor in response to the light output, so as to control the integrated light output of the display during the address period.

FIGS. 3 and 4 show examples of pixel layout for this purpose. Further examples of this type of pixel configuration are described in detail in WO 01/20591 and EP 1 096 466.

In the pixel circuit of FIG. 3, a photodiode 27 discharges the gate voltage stored on the capacitor 24 ($C_{data}$), causing the brightness to reduce. The EL display element 2 will no longer emit when the gate voltage on the drive transistor 22 ($T_{drive}$) reaches the threshold voltage, and the storage capacitor 24 will then stop discharging. The rate at which charge is leaked from the photodiode 27 is a function of the display element output, so that the photodiode 27 functions as a light-sensitive feedback device. Once the drive transistor 22 has switched off, the display element anode voltage reduces causing the discharge transistor 29 ($T_{discharge}$) to turn on, so that the remaining charge on the storage capacitor 24 is rapidly lost and the luminance is switched off.

As the capacitor holding the gate-source voltage is discharged, the drive current for the display element drops gradually. Thus, the brightness tails off. This gives rise to a lower average light intensity.

FIG. 4 shows a circuit which has been proposed by the applicant, and which has a constant light output and then switches off at a time dependent on the light output.

The gate-source voltage for the drive transistor 22 is again held on a storage capacitor 24 ($C_{store}$). However, in this circuit, this capacitor 24 is charged to a fixed voltage from a charging line 32, by means of a charging transistor 34. Thus, the drive transistor 22 is driven to a constant level which is independent of the data input to the pixel when the display element is to be illuminated. The brightness is controlled by varying the duty cycle, in particular by varying the time when the drive transistor is turned off.

The drive transistor 22 is turned off by means of a discharge transistor 36 which discharges the storage capacitor 24. When the discharge transistor 36 is turned on, the capacitor 24 is rapidly discharged and the drive transistor turned off.

The discharge transistor 36 is turned on when the gate voltage reaches a sufficient voltage. A photodiode 27 is illuminated by the display element 2 and again generates a photocurrent in dependence on the light output of the display element 2. This photocurrent charges a discharge capacitor 40 ($C_{data}$), and at a certain point in time, the voltage across the capacitor 40 will reach the threshold voltage of the discharge transistor 36 and thereby switch it on. This time will depend on the charge originally stored on the capacitor 40 and on the photocurrent, which in turn depends on the light output of the display element. The discharge capacitor initially stores a data voltage, so that both the initial data and the optical feedback influence the duty cycle of the circuit.

These circuits are both limited by the turn-on rate of the discharge transistor, giving a constant light error in the correction ability of the circuit. The performance of the optical feedback compensation circuit of FIG. 3 is also is not as good at lower light (grey) levels. This is because optical feedback relies upon light to make the correction, so if there is less light the correction will not work as rapidly. As there is a finite frame time, the correction is poorer than at a higher pixel brightness.

According to the invention, there is provided an active matrix display device comprising an array of display pixels, each pixel comprising:

a current-driven light emitting display element;

a drive transistor for driving a current through the display element;

a storage capacitor for storing a voltage to be used for controlling the addressing of the drive transistor;

a light-dependent device for controlling discharge of the storage capacitor, thereby to alter the control of the drive transistor in dependence on the light output of the display element; and a circuit associated with the drive transistor for increasing the rate of discharge of the storage capacitor when the storage capacitor is discharged in response to the light dependent device output.

The device of the invention thus uses optical feedback to control the discharge of a storage capacitor, but uses additional circuit elements to improve the rate of capacitor discharge, and therefore switch off of the drive transistor, when the optical feedback system operates to switch off the drive transistor.

Essentially, the invention makes use of an in-pixel gain system to ensure that good correction for differential aging is obtained at all grey levels. The circuit of the invention thus improves the circuit performance at all grey levels which result from light errors caused by slow discharge of the storage capacitor.

The storage capacitor may be for the data voltage or for a fixed voltage, depending on the implementation.

The device may operate with gradual discharge of the storage capacitor. Alternatively, a discharge transistor can be provided for discharging the storage capacitor thereby to switch off the drive transistor. This operates more quickly, and the circuit then functions as a duty cycle control system.

In particular, the light-dependent device can then control the timing of the switching of the discharge transistor from an off to an on state, and the discharge transistor is for charging or discharging a discharge capacitor provided between the gate of the discharge transistor and a constant voltage line.

The circuit associated with the drive transistor may comprise a second transistor in series with the drive transistor, such that the second transistor and the drive transistor form an inverter circuit, the output of the inverter circuit driving the display element. In this way, gain is introduced into the signal which controls the capacitor discharge, thereby enabling the rate of discharge to be increased.

The circuit associated with the drive transistor may comprise a complete additional inverter circuit, the output of the inverter circuit controlling the drive transistor. The inverter circuit may be clocked.

In versions using a discharge transistor, the circuit associated with the drive transistor may additionally, or alternatively, comprise a feedback transistor, wherein the discharge transistor connects to the gate of the feedback transistor and the feedback transistor connects to the gate of the discharge transistor. This arrangement defines a positive feedback path which accelerates the rate at which the discharge transistor can discharge the storage capacitance.

The light dependent device preferably comprises a discharge photodiode, and each pixel may further comprises an address transistor connected between a data signal line and an input to the pixel.

The invention will now be described by way of example with reference to the accompanying drawings, in which.

Figure 1:
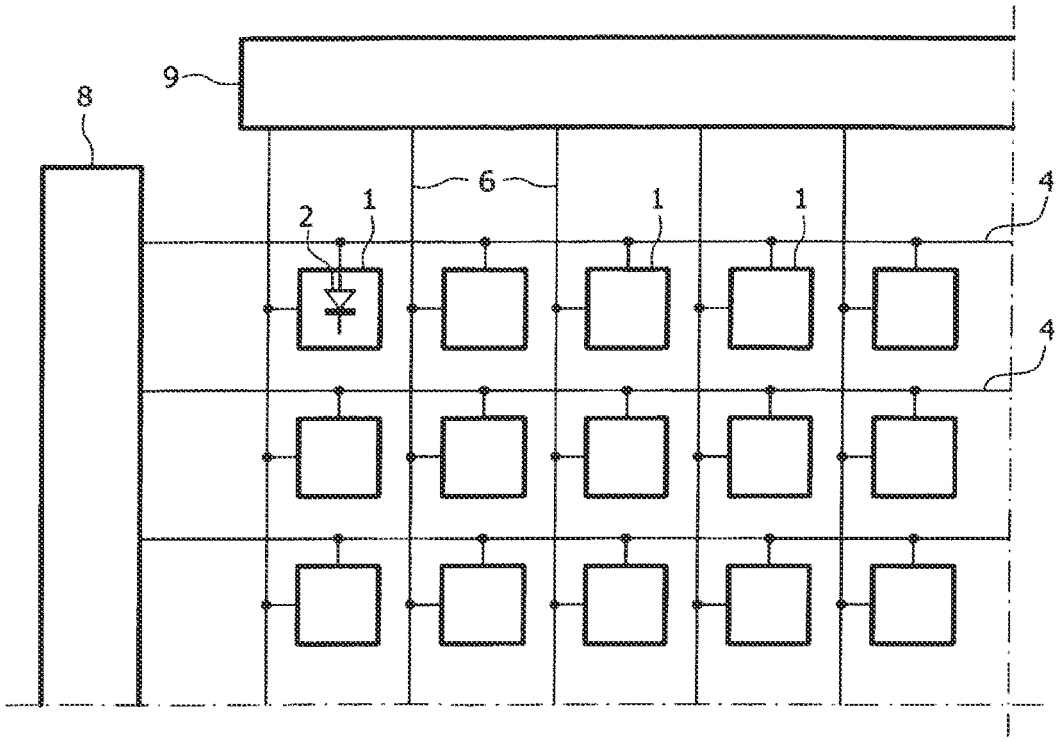
FIG. 1 PRIOR ART
FIG. 1 shows a known EL display device.
Figure 2:
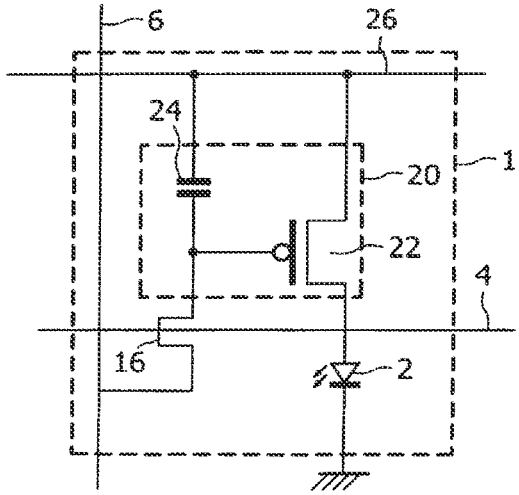
FIG. 2 PRIOR ART
FIG. 2 is a simplified schematic diagram of a known pixel circuit for current-addressing the EL display pixel.
Figure 3:
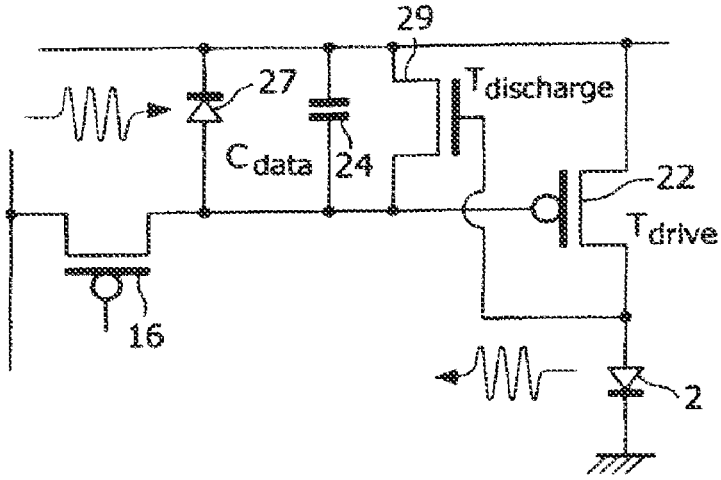
FIG. 3 PRIOR ART
FIG. 3 shows a first known pixel design which compensates for differential aging.
Figure 4:
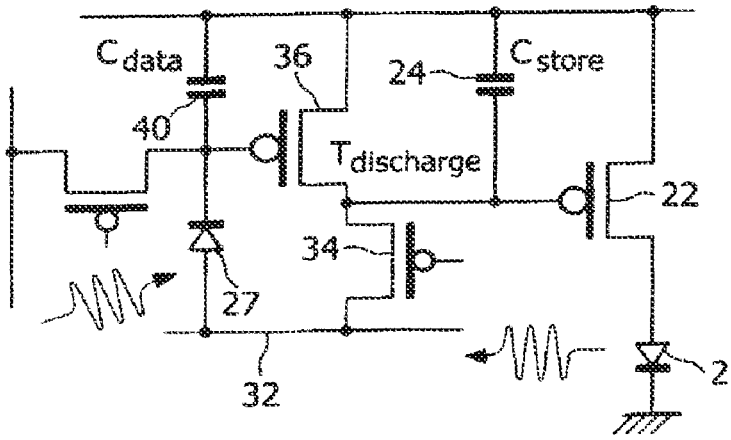
FIG. 4 PRIOR ART
FIG. 4 shows a second known pixel design which compensates for differential aging.
Figure 5:
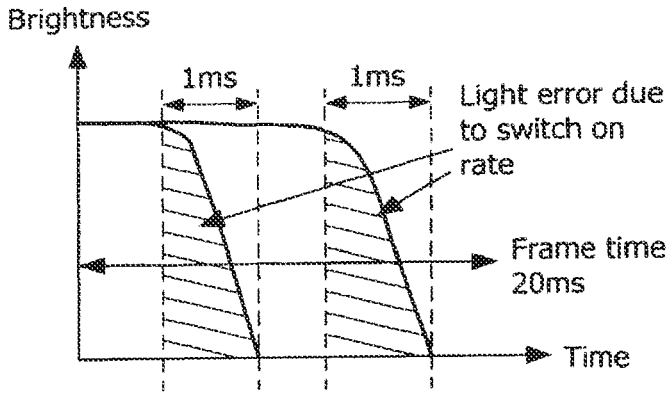
FIG. 5 is used to explain problems associated with previously proposed optical feedback circuits.

FIG. 5 is used to explain the problem addressed by the invention, and shows two grey levels that are determined by the areas under each curve, using the circuit of FIG. 4. The same problem applies to the circuit of FIG. 3, but there is no period of constant light output in that circuit. The shaded regions are the error caused by the turn on time of the discharge transistor. The area is constant for all grey levels therefore the error becomes more severe at lower grey levels. Pixel circuit performance improvements can be therefore be obtained by reducing this turn-on time.

The invention provides a display device using optical feedback for ageing compensation, in which a circuit is associated with the drive transistor of the pixel for increasing the rate of discharge of the storage capacitor when the storage capacitor is discharged in response to the light dependent device output. The invention essentially provides a pixel design in which a gain stage is provided within the pixel for the signal used to discharge the storage capacitor.

Figure 6:
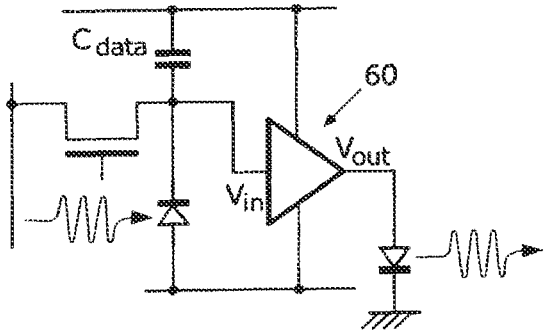
FIG. 6 shows a first generalised example of pixel circuit according to the invention.
Figure 7:
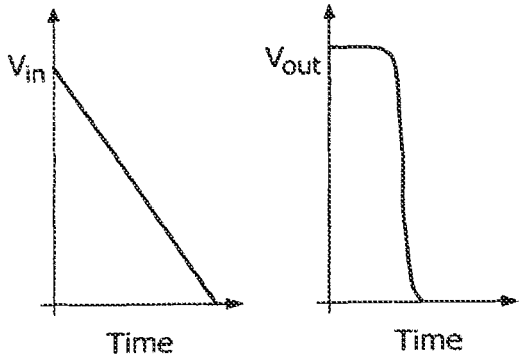
FIG. 7 is used to explain the operation of the circuit of FIG. 6.

A generalised diagram of a pixel circuit of the invention is shown in FIG. 6, and FIG. 7 shows the function of the amplifier used in the circuit of FIG. 6.

In FIG. 6, an amplifier 60 is provided between the optical feedback circuit elements (the photodiode and capacitor which it discharges) and the display element. In the generalised circuit of FIG. 6, the amplifier 60 includes the pixel drive transistor.

As shown in FIG. 7, the function of the amplifier is to provide a sharper cutoff to the control signal provided by the optical feedback system.

In operation of the circuit, the light-dependent photocurrent will charge the data capacitance linearly over a frame time. At some point, the high-gain stage will switch very rapidly between the power lines. Therefore the correction error of the circuit will be limited by the time needed for the gain stage to switch between the power lines, this can be very short compared with the turn-on time of an individual discharge transistor. The circuit thus enables an improved degree of correction.

Figure 8:
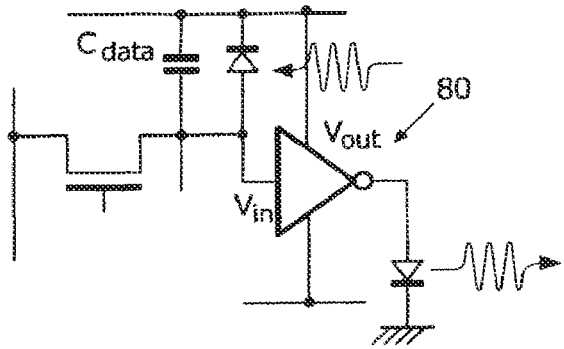
FIG. 8 shows a second generalised example of pixel circuit according to the invention.
Figure 9:
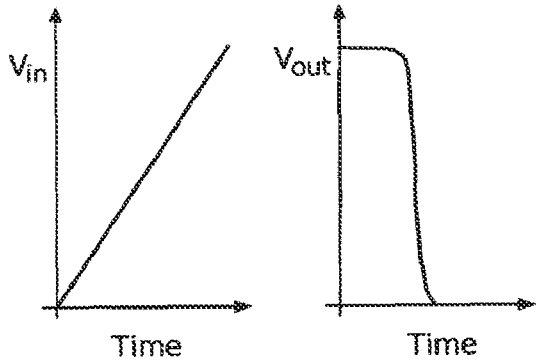
FIG. 9 is used to explain the operation of the circuit of FIG. 8.

FIG. 8 shows in generalised form an inverse scheme whereby the photocurrent discharges the data capacitance causing the input voltage $V_{in}$ to the amplifier 80 to rise, so that the output $V_{out}$ switches from high to low, as shown in FIG. 9. The amplifier 80 in FIG. 8 represents an inverse high gain stage—but not necessarily a standard digital inverter.

The arrangement of photodiode and data capacitor can be implemented is several ways, and only two basic implementations are shown above. IN general, the circuits create a linearly increasing/decreasing voltage $V_{in}$ whose rate of increase/decrease depends upon the luminance of the OLED.

A third general scheme is to use a clocked high gain stage. This is shown in FIGS. 10 and 11.

Figure 10:
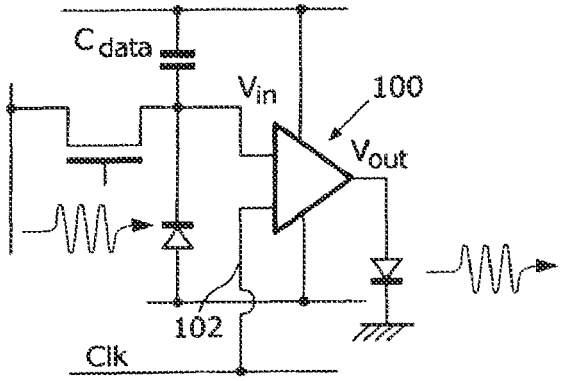
FIG. 10 shows a third generalised example of pixel circuit according to the invention.
Figure 11:
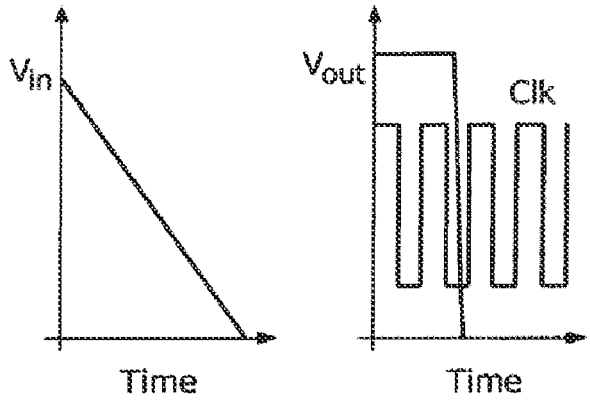
FIG. 11 is used to explain the operation of the circuit of FIG. 10.

The circuit of FIG. 10 corresponds to that of FIG. 6, but the amplifier 100 has an additional clock input 102.

In this scheme, the high gain stage is not allowed to switch until the clock (Clk) has a predetermined state (high or low or at a transition). Therefore if the input voltage $V_{in}$ is sufficiently high to switch the gain stage it has to wait for the clock to reach an appropriate state before it can switch and the accuracy of the system is then limited by the number of clock cycles per field period. The clocked circuit of FIG. 10 is easily envisaged.

A number of detailed implementations of the invention will now be given.

Figure 12:
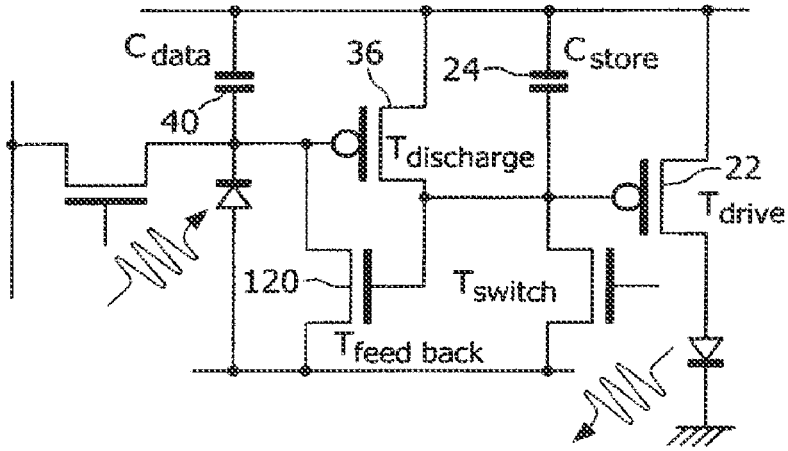
FIG. 12 shows a first detailed pixel circuit of the invention.

A first implementation is shown in FIG. 12. This is a scheme with a constant drive voltage to the drive transistor, and is thus a duty cycle scheme as explained above.

The circuit of FIG. 12 corresponds to that of FIG. 4, but with the addition of a feedback transistor 120 ($T_{feedback}$). The operation of the other circuit elements will not be described.

The feedback transistor 120 is an n-type TFT, which starts to switch on just as the discharge transistor 36 ($T_{discharge}$) is switching on. It effectively gives high gain by positive feedback to the data storage node (the node between the photodiode and the discharge capacitor 40 ($C_{data}$). This feedback scheme thus functions as an amplifier stage and increases the rate of discharge of the storage capacitor when the optical feedback system triggers the discharge of the storage capacitor.

In this example, the discharge transistor is connected between the high power rail and the gate of the feedback transistor and the feedback transistor connects between the gate of the discharge transistor and the low power rail.

When the feedback transistor turns on (because the discharge transistor starts to conduct) it pulls down the discharge transistor gate voltage, thereby accelerating the turn-on of the discharge transistor.

To achieve a good black state with this circuit, it may be necessary to have a switch between the drive transistor $T_{drive}$ and the LED. The address line of this switch can be connected to the address line for the transistor $T_{switch}$ (which is the transistor for charging the storage capacitor) if these two transistors are complementary.

Figure 13:
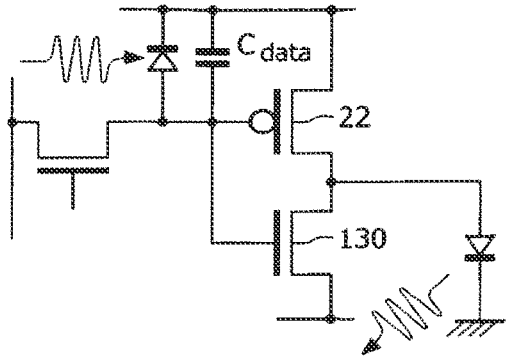
FIG. 13 shows a second detailed pixel circuit of the invention.
Figure 14:
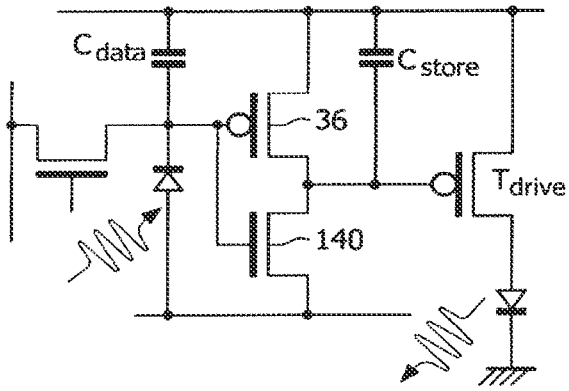
FIG. 14 shows a third detailed pixel circuit of the invention.

A second implementation is shown in FIGS. 13 and 14.

In FIG. 13, the discharge transistor $T_{discharge}$ of FIG. 3 has been replaced by a second transistor 130 in series with the drive transistor 22, such that the second transistor 130 and the drive transistor 22 form an inverter circuit. The output of the inverter circuit drives the display element.

The inverter circuit effectively provides gain.

The circuit of FIG. 13 provides gradual discharge of the storage capacitor in the same way as the circuit of FIG. 3.

FIG. 14 shows a similar modification to the circuit of FIG. 4, and is thus a duty cycle control circuit. Again, an inverter is provided by the discharge transistor and an additional transistor 140.

Figure 15:
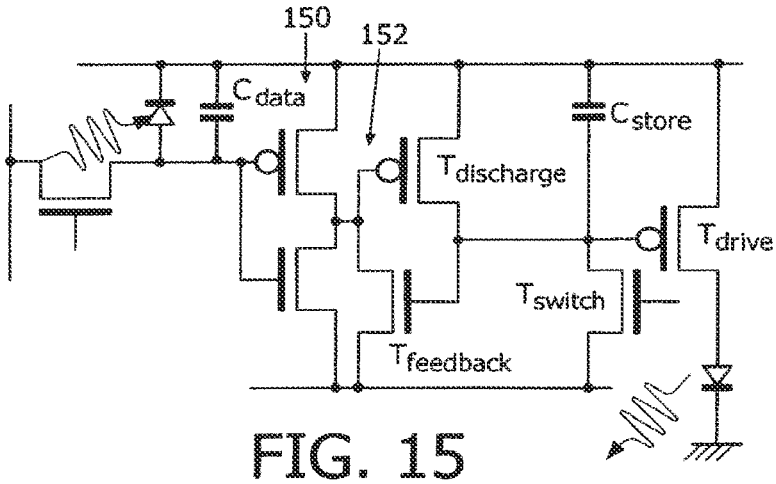
FIG. 15 shows a fourth detailed pixel circuit of the invention.

FIG. 15 shows a circuit which combines the feedback circuit of FIG. 12 and the inverter circuit of FIG. 14. Thus the circuit of FIG. 15 has an inverter stage 150 and a feedback stage 152, which each operate in the manner explained above.

In this circuit, the gain provided by the inverter stage 150 is further amplified by the feedback combination of $T_{discharge}$ and $T_{feedback}$ to give a very high gain system. Again, to achieve a good black state with this circuit it may be necessary to have a switch between the drive TFT $T_{drive}$ and the LED. The address line of this switch can again be connected to the address line for $T_{switch}$ if these two transistors are complementary.

A standing current through the inverter will occur when the LED has turned off, which is unwanted.

Figure 16:
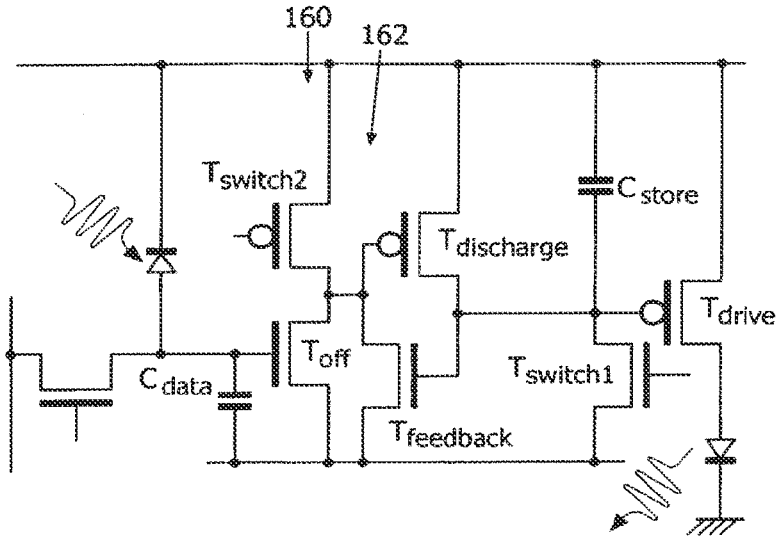
FIG. 16 shows a sixth detailed pixel circuit of the invention.

FIG. 16 shows a similar circuit but the inverter stage 160 has now been split into two independently controlled transistors ($T_{off}$ and $T_{switch2}$), to avoid the static power consumption of the inverter. The feedback system is shown as 162. The transistor $T_{off}$ turns on when the capacitor $C_{data}$ is sufficiently charged, which causes the positive feedback system to rapidly switch off the display element.

The transistor $T_{Switch2}$ is on only during addressing, and is off otherwise, so that the static power consumption of the inverter stage is reduced.

Figure 17:
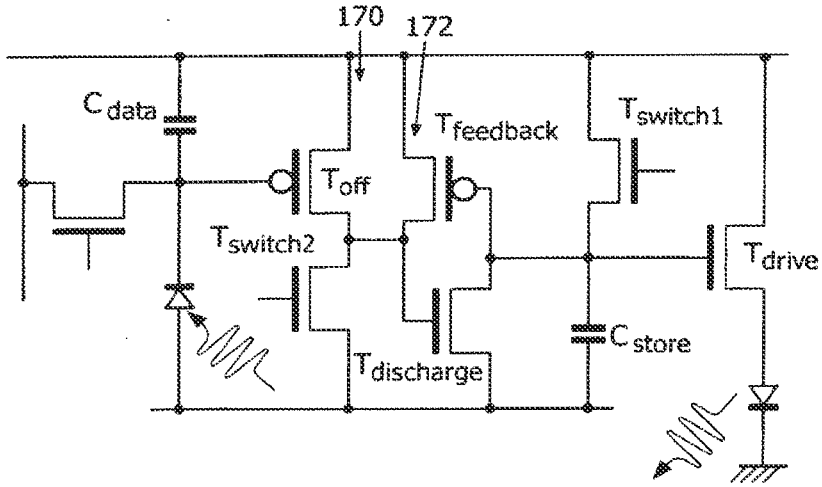
FIG. 17 shows a seventh detailed pixel circuit of the invention.

FIG. 17 shows a variation to FIG. 16 in which the data capacitor is discharged rather than charged by the photodiode, and the arrangement of the inverter 170 and feedback system 172 are altered. This simply illustrates that the circuits may each be implemented in a number of specific ways.

Figure 18:
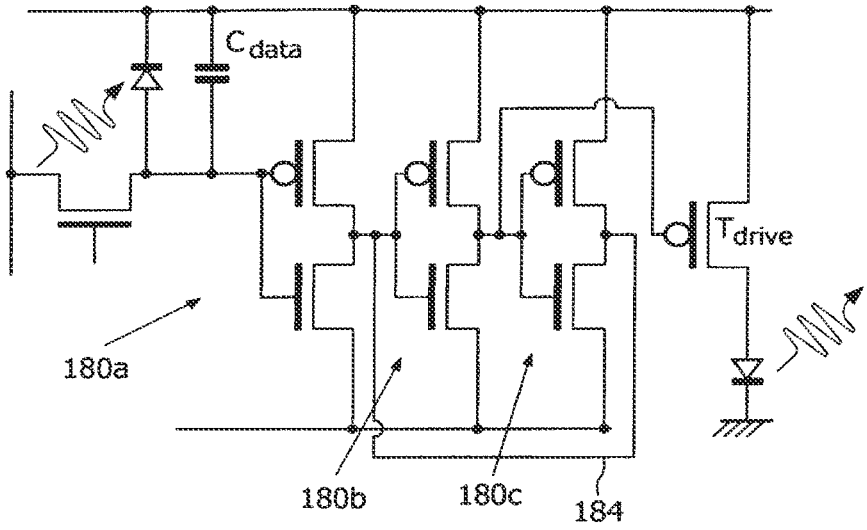
FIG. 18 shows an eighth detailed pixel circuit of the invention.
Figure 19:
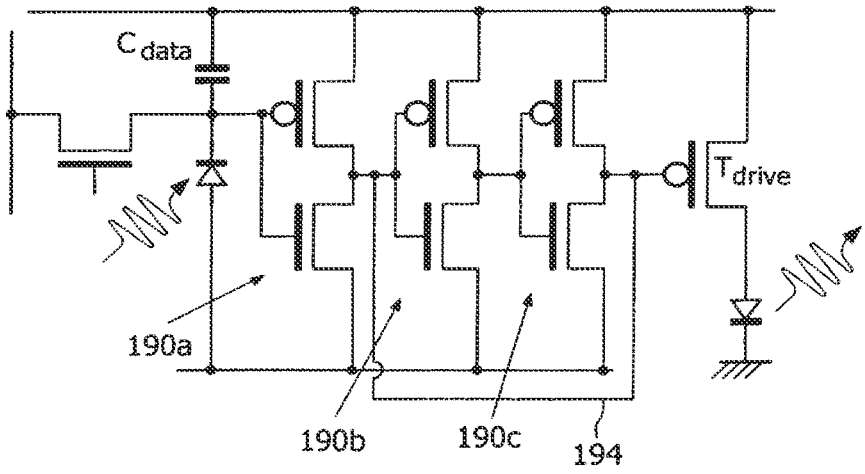
FIG. 19 shows a ninth detailed pixel circuit of the invention.

FIGS. 18 and 19 show two variations of an alternative high gain system. In these circuits there are three inverters 180*a*, 180*b*, 180*c* and 190*a*, 190*b*, 190*c*. The second two inverter stages have a positive feedback connection 184, 194 between the input to the second inverter 180*b*, 190*b* and the output of the third inverter.

These implementations do not need the charging switch $T_{switch}$, a separate capacitor or an additional transistor between the drive transistor and the LED for a good black state. The voltage on the data column automatically achieves these functions at the address time.

The output of the second inverter stage holds the gate of the drive transistor at a fixed voltage by tying the gate to one of the voltage rails, so that the storage capacitor is not required. When the inverter circuits switch, the drive transistor gate is rapidly pulled to the opposite power rail, and the timing is again dependent on the initial data voltage on the capacitor $C_{data}$ and the optical feedback system.

In these circuits, the data storage capacitor is again for storing a voltage to be used for controlling the addressing of the drive transistor. However, no capacitor is required for storing the drive transistor gate-source voltage as in the previous circuits.

The second and third inverters with feedback can be considered as an SRAM cell. The TFTs will all be minimum dimension so aperture can be maintained even though there are 8 transistors in the circuit.

Figure 20:
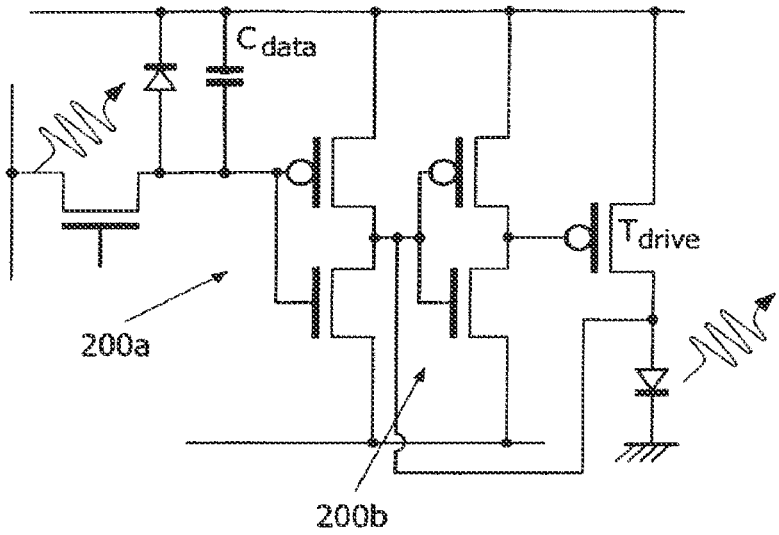
FIG. 20 shows a tenth detailed pixel circuit of the invention.

The number of transistors can be reduced, for example the last inverter 180*c* of FIG. 18 can be removed so that the circuit becomes that shown in FIG. 20 having two inverter stages 200*a*, 200*b*. The feedback to the input of the second stage 200*b* is from the junction between the drive transistor and the LED. The combination of the drive transistor and the LED now acts as the final inverter.

The linear increase in voltage (over a proportion of the frame time) on the input to the first inverter 180*a*, 190*a*, 200*a* in FIGS. 18 to 20 caused by the photocurrent charging the data capacitance causes the inverter to pass current until the SRAM section switches. Making the TFTs in this inverter long (low W/L ratio) will reduce the amount of current passed by the first inverter.

Figure 21:
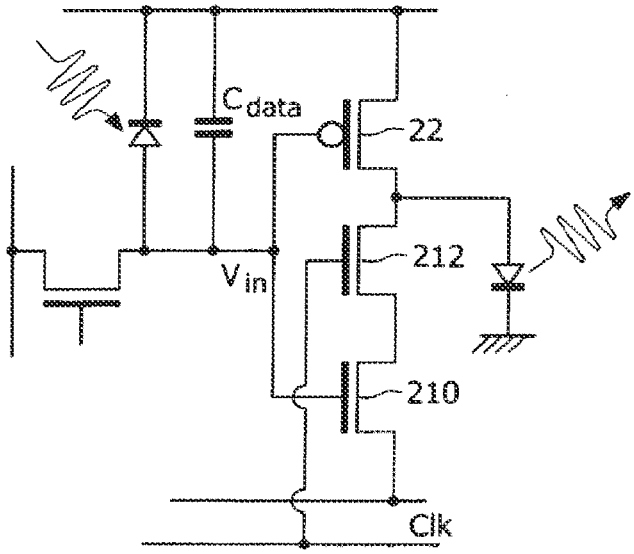
FIG. 21 shows an eleventh detailed pixel circuit of the invention.

FIG. 21 shows a clocked system as a modification to the circuit of FIG. 13. An inverter is defined by the drive transistor 22 and an additional transistor 210, and it is clocked by a single transistor 212 so when the input voltage $V_{in}$ has reached a voltage sufficiently high to switch the inverter it has to wait until the clock signal Clk goes high before the inverter can change state and turn-off the LED.

In such a system, the number of clock cycles within a frame time needs to be higher than the number of grey-levels by at least factor of two.

The circuits above correct for differential aging in OLED displays to a very high degree, and in some cases simulation shows correction of under 0.5% for 50% degradation in the OLED efficiency at full brightness. At lower grey levels the performance is only slightly changed.

The circuits can all be implemented at very low voltage levels, e.g. 5V, so the power consumption is determined almost entirely by the current and voltage required to operate the LEDs. The invention is therefore suitable for applications in which low power with no burn-in is important.

The circuits do not compensate for TFT non-uniformity, but in many applications this is far less critical than the effects of ageing.

In the examples above, the light dependent element is a photodiode, but pixel circuits may be devised using phototransistors or photoresistors. The circuits of the invention can be implemented using a variety of transistor semiconductor technologies. A number of variations are possible, for example crystalline silicon, hydrogenated amorphous silicon, polysilicon and even semiconducting polymers. These are all intended to be within the scope of the invention as claimed.

In some circuits described above, the photodiode (or other light sensitive element) is used to discharge directly the capacitor holding the drive transistor gate voltage, and in other duty-cycle control circuits, it is used to discharge an additional capacitor which controls the discharge transistor. In each case, the light-dependent device either directly or indirectly controls discharge of the storage capacitor holding the drive transistor gate voltage, and thereby alters the control of the drive transistor in dependence on the light output of the display element. Thus, all circuit examples above have a light-dependent device for controlling discharge of the storage capacitor, thereby to alter the control of the drive transistor in dependence on the light output of the display element.

The display devices may be polymer LED devices, organic LED devices, phosphor containing materials and other light emitting structures.

Various other modifications will be apparent to those skilled in the art.

The invention claimed is:

1. An active matrix display device comprising an array of display pixels, each pixel comprising:

a current-driven light emitting display element (2);

a drive transistor (22) for driving a current through the display element;

a storage capacitor (24) for storing a voltage to be used for controlling the addressing of the drive transistor (22; 40);

a light-dependent device (27) for controlling discharge of the storage capacitor (24), thereby to alter the control of the drive transistor in dependence on the light output of the display element; and a circuit (60) associated with the drive transistor for increasing the rate of discharge of the storage capacitor (24) when the storage capacitor is discharged in response to the light dependent device (27) output, wherein the circuit associated with the drive transistor comprises a clocked inverter circuit (36,140), the output of the inverter circuit controlling the drive transistor.

2. A device as claimed in claim 1, further comprising a discharge transistor (36) for discharging the storage capacitor (24) thereby to switch off the drive transistor (22).

3. A device as claimed in claim 2, wherein the light-dependent device controls the timing of the switching of the discharge transistor (36) from an off to an on state.

4. A device as claimed in claim 2, wherein a discharge capacitor (40) is provided between the gate of the discharge transistor (36) and a constant voltage line, and the light dependent device is for charging or discharging the discharge capacitor (40).

5. A device as claimed in claim 1, wherein the circuit associated with the drive transistor comprises a second transistor (130) in series with the drive transistor (22), such that the second transistor (130) and the drive transistor (22) form an inverter circuit, the output of the inverter circuit driving the display element.

6. A device as claimed in claim 1, wherein the circuit associated with the drive transistor comprises a feedback transistor ($T_{feedback}$), wherein the discharge transistor ($T_{discharge}$) connects to the gate of the feedback transistor and the feedback transistor connects to the gate of the discharge transistor.

7. A device as claimed in claim 1, wherein the light dependent device (27) comprises a discharge photodiode.

8. A device as claimed in claim 1, wherein each pixel further comprises an address transistor (16) connected between a data signal line and an input to the pixel.

9. A device as claimed in claim 1, wherein the drive transistor is connected between a power supply line and the display element.

10. A device as claimed in claim 9, wherein the storage capacitor (24) is connected between the gate and source of the drive transistor (22).

* * * * *